US008944476B1

(12) United States Patent
Henderson

(10) Patent No.: US 8,944,476 B1
(45) Date of Patent: Feb. 3, 2015

(54) LATCH ASSEMBLIES AND TRANSPORTATION CONTAINERS USING THE SAME

(71) Applicant: Royal Case Co., Inc., Sherman, TX (US)

(72) Inventor: Larry Henderson, Whitewright, TX (US)

(73) Assignee: Royal Case Co., Inc., Sherman, TX (US)

( * ) Notice: Subject to any disclaimer, the term of this patent is extended or adjusted under 35 U.S.C. 154(b) by 107 days.

(21) Appl. No.: 13/658,173

(22) Filed: Oct. 23, 2012

(51) Int. Cl.
*E05C 5/00* (2006.01)
*E05C 19/12* (2006.01)

(52) U.S. Cl.
USPC ..... 292/113; 292/95; 292/285; 292/DIG. 49; 292/DIG. 48

(58) Field of Classification Search
CPC ..... E05C 3/14; E05C 19/06; E05C 19/08; E05C 19/10; E05C 19/12; E05C 19/14; E05B 15/04; E05B 17/0025; E05B 65/48; E05B 65/50; E05B 65/52; E05B 65/5246; B65D 45/16; B65D 45/24; A45C 13/1084
USPC ..... 292/95, 109, 110, 113, 116, 117, 118, 292/247, 256.69, 285, DIG. 49, DIG. 48; 220/4.22–4.24
See application file for complete search history.

(56) References Cited

U.S. PATENT DOCUMENTS

| | | | | |
|---|---|---|---|---|
| 4,181,333 | A * | 1/1980 | Stelma | 292/66 |
| 4,660,871 | A * | 4/1987 | Arakawa et al. | 292/81 |
| 5,060,492 | A * | 10/1991 | Carpenter et al. | 70/73 |
| 5,385,257 | A * | 1/1995 | Hung | 220/324 |
| 5,526,953 | A * | 6/1996 | Chieng | 220/4.23 |
| 5,638,709 | A * | 6/1997 | Clavin | 70/208 |
| 6,527,309 | B1 * | 3/2003 | Gaydos et al. | 292/128 |
| 7,370,891 | B1 * | 5/2008 | Schmitt et al. | 292/113 |
| 7,540,364 | B2 * | 6/2009 | Sanderson | 190/119 |
| 7,837,053 | B2 * | 11/2010 | Arnett et al. | 220/326 |
| 2006/0017293 | A1 * | 1/2006 | Tonelli | 292/202 |
| 2008/0308568 | A1 * | 12/2008 | Grenier et al. | 220/810 |
| 2011/0084075 | A1 * | 4/2011 | Arnett et al. | 220/326 |
| 2011/0132046 | A1 * | 6/2011 | Tonelli | 70/69 |

* cited by examiner

*Primary Examiner* — Kristina Fulton
*Assistant Examiner* — Christine M Mills
(74) *Attorney, Agent, or Firm* — James J. Murphy; Thompson & Knight LLP

(57) ABSTRACT

A latch assembly includes a closing panel having an end with a closing panel tab extending therefrom. A clasp lever is pivotally attached to the end of closing panel and forms a space into which the closing panel tab extends. Inner peripheral sidewalls of the clasp lever forming the space allow the clasp lever to rotate around outer peripheral sidewalls of the closing panel tab when the clasp lever pivots around the end of the closing panel. An incessant force component is disposed within the space between the closing panel tab and a rear inner sidewall of the clasp lever and biases the clasp lever to a neutral position with respect to the closing panel. A force applied to an outer surface of the clasp lever against the bias causes the clasp lever to pivot around the end of the closing panel from the neutral position.

22 Claims, 6 Drawing Sheets

LATCH ASSEMBLIES AND TRANSPORTATION CONTAINERS USING THE SAME

FIELD OF INVENTION

The present invention relates in general to transportation containers, and in particular to latch assemblies suitable for use with transportation containers.

BACKGROUND OF INVENTION

Latch assemblies, including those used with transportation containers, are ubiquitous. Nevertheless, new latch assembly designs are always necessary to meet the challenges presented when new types of transportation containers are developed, new operating environments are faced, or both. Among other things, a properly designed and constructed latch assembly must provide for a firm engagement between container components (e.g., the container lid and the base), withstand the stresses of the intended operating environment, and allow for the use of efficient manufacturing processes.

SUMMARY OF INVENTION

One embodiment of the principles of the present invention is a latch assembly that includes a closing panel having an end with a closing panel tab extending therefrom. A clasp lever is pivotally attached to the end of closing panel and forms a space into which the closing panel tab extends. Inner peripheral sidewalls of the clasp lever around the periphery of the space allow the clasp lever to rotate past outer peripheral sidewalls of the closing panel tab when the clasp lever pivots around the end of the closing panel. An incessant force component is disposed within the space between a rear sidewall of the closing panel tab and a rear inner sidewall of the clasp lever and biases the clasp lever to a neutral position with respect to the closing panel. A force applied to an outer surface of the clasp lever against the bias causes the clasp lever to pivot around the end of the closing panel from the neutral position.

Latch assemblies according to the inventive principles advantageously require significantly less force to engage and disengage from the associated container, in comparison to traditional one-piece latches, while still providing the required security under a wide range of conditions. Furthermore, the ergonomic design of these latch assemblies allows the user to engage and disengage the latch using natural gestures, which minimizes fatigue and maximizes user comfort.

BRIEF DESCRIPTION OF DRAWINGS

For a more complete understanding of the present invention, and the advantages thereof, reference is now made to the following descriptions taken in conjunction with the accompanying drawings, in which.

DETAILED DESCRIPTION OF THE INVENTION

The principles of the present invention and their advantages are best understood by referring to the illustrated embodiment depicted in FIGS. 1-3 of the drawings, in which like numbers designate like parts.

Figure 1A:
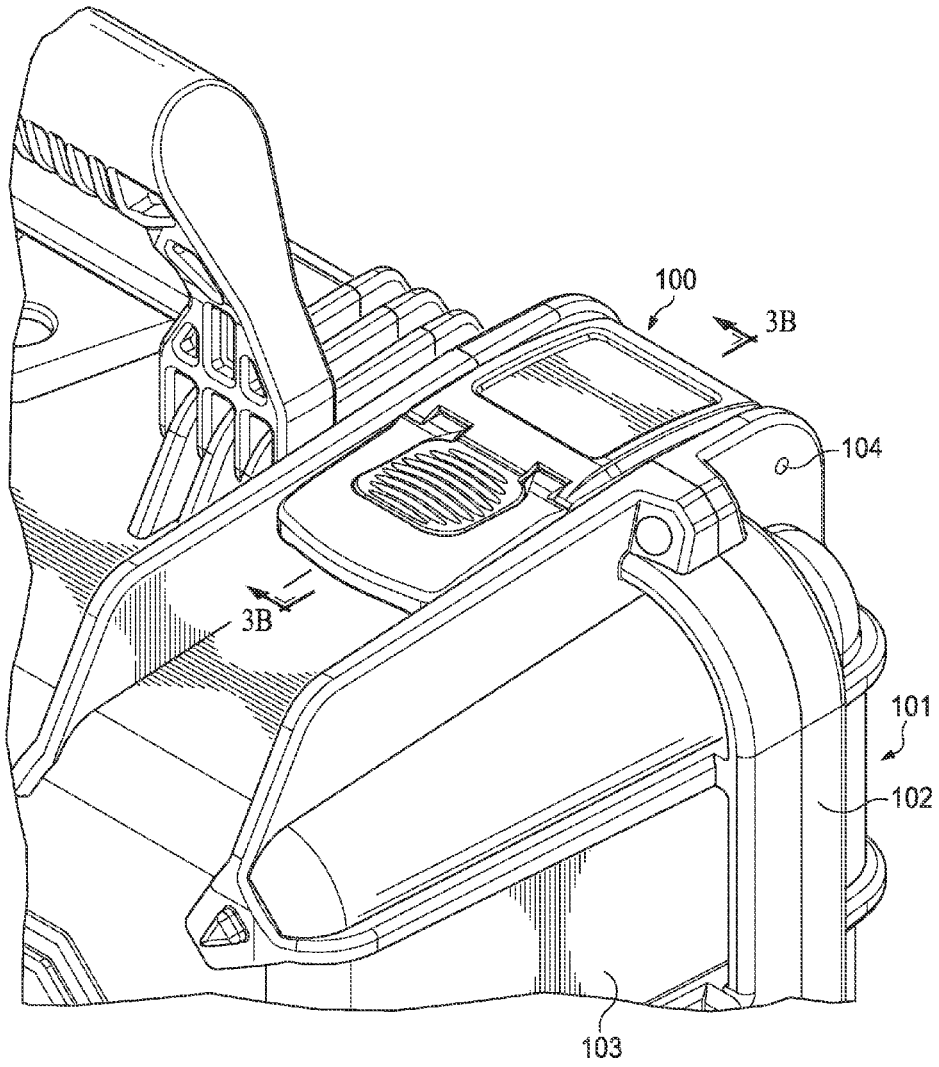
FIG. 1A is a diagram of a portion of a transportation container with a representative latch assembly embodying the principles of the present invention, with the latch assembly shown in the engaged (latched) configuration.
Figure 1B:
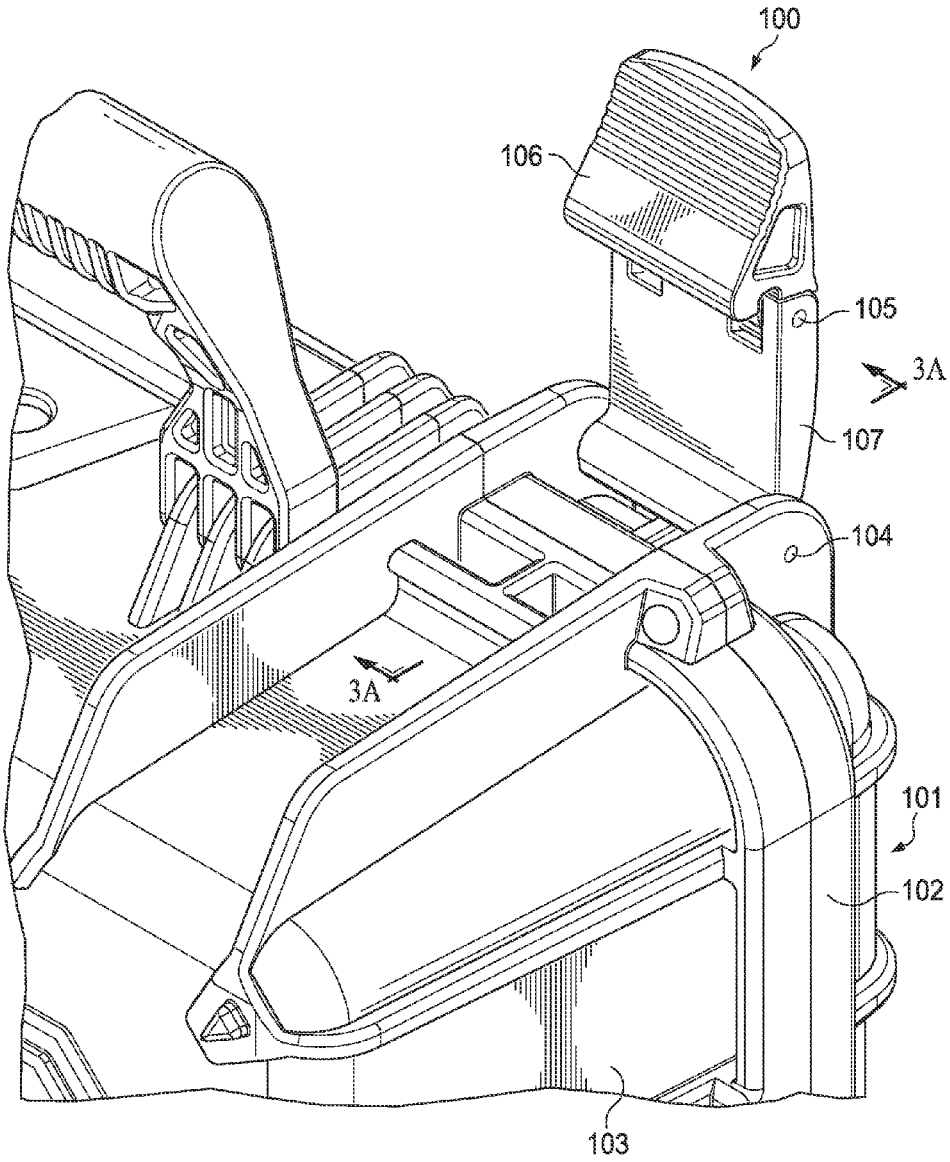
FIG. 1B is another diagram illustrating the representative latch assembly in the disengaged (unlatched) configuration.

FIGS. 1A and 1B illustrate an exemplary transportation container 101 utilizing a spring latch assembly 100 according to a preferred embodiment of the present inventive principles. FIG. 1A shows latch assembly 100 in the engaged (latched) configuration and FIG. 1B shows latch assembly 100 in the disengaged (unlatched) configuration.

As shown in FIGS. 1A and 1B, transportation container 101 is a molded plastic container suitable for use as luggage or for transporting tools, musical instruments, or other equipment. Transportation container 101 generally includes an upper or lid section 102 that pivots with respect to a lower or base section 103 at axis points (not shown) at the opposing side the container. Alternatively, lid section 102 and base section 103 are completely separable. The construction of transportation container 101 may change as a matter of design choice. For example, transportation container 101 may be constructed of different materials (e.g., metal), or the size, shape, or external appendages may change, depending on the desired aesthetics or intended use.

One end of a closing panel 107 of latch assembly 100 is attached to upper container section 102 with a upper fixed pin 104 Upper fixed pin provides a fulcrum (axis) point around which latch assembly 100 pivots. Lower fixed pin 105 provides a fulcrum (axis) point around which a clasp lever 106 pivots with respect to closing panel 107.

Figure 2A:
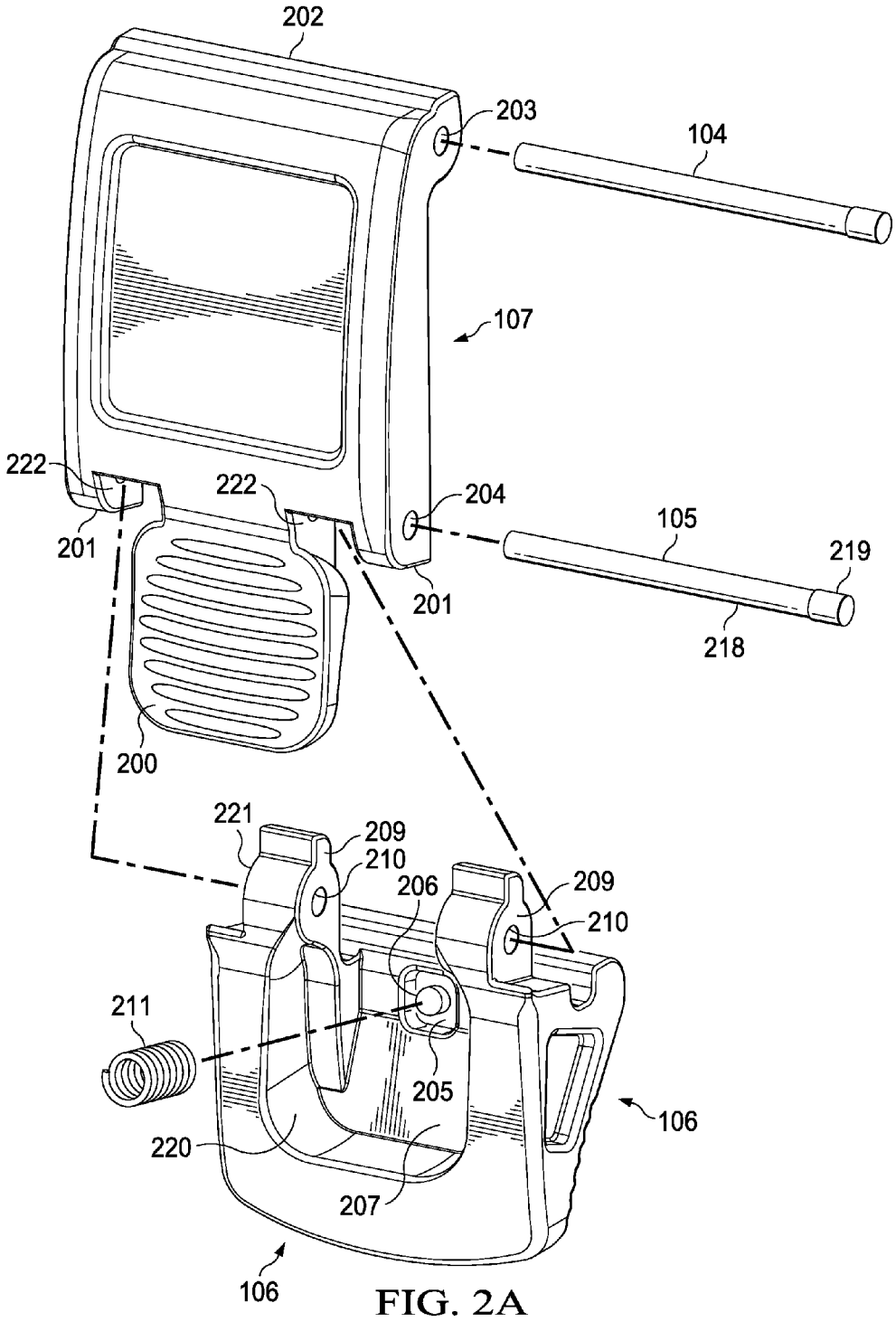
FIGS. 2A and 2B are diagrams providing front and rear exploded views of the latch assembly of FIGS. 1A and 1B.

FIG. 2A is an exploded view taken from the front of latch assembly 100, including closing panel 107 and clasp lever 106. Closing panel 107, which in the illustrated embodiment is single body of molded plastic, includes a thumb grip surface on a tab 200, downward (inward) rotational travel-limiting surfaces 201, and a pivot lock rib 202. An aperture 203 receives upper fixed pin 105. Aligned apertures 204 receive lower fixed pin 105.

Clasp lever 106, which is also preferably a single, generally V-shaped, body of molded plastic, includes encasement pocket 205 extending into the body of a rear portion of clasp lever 106, an alignment rod 206 encompassed by encasement pocket 205 and extending outward from the rear wall of the clasp lever body, a clasp upward (outward) rotational travel-limiting surface 207, clasp downward (inward) rotational travel-limiting surface 208, and four (4) lateral shifting and travel limiting surfaces 209. Aligned apertures 210 receive lower fixed pin 105.

An incessant force component 211, which is preferably a helical spring, is disposed between closing panel 107 and clasp lever 106, with the spring longitudinal aperture receiving clasp lever alignment rod 206.

Figure 2B:
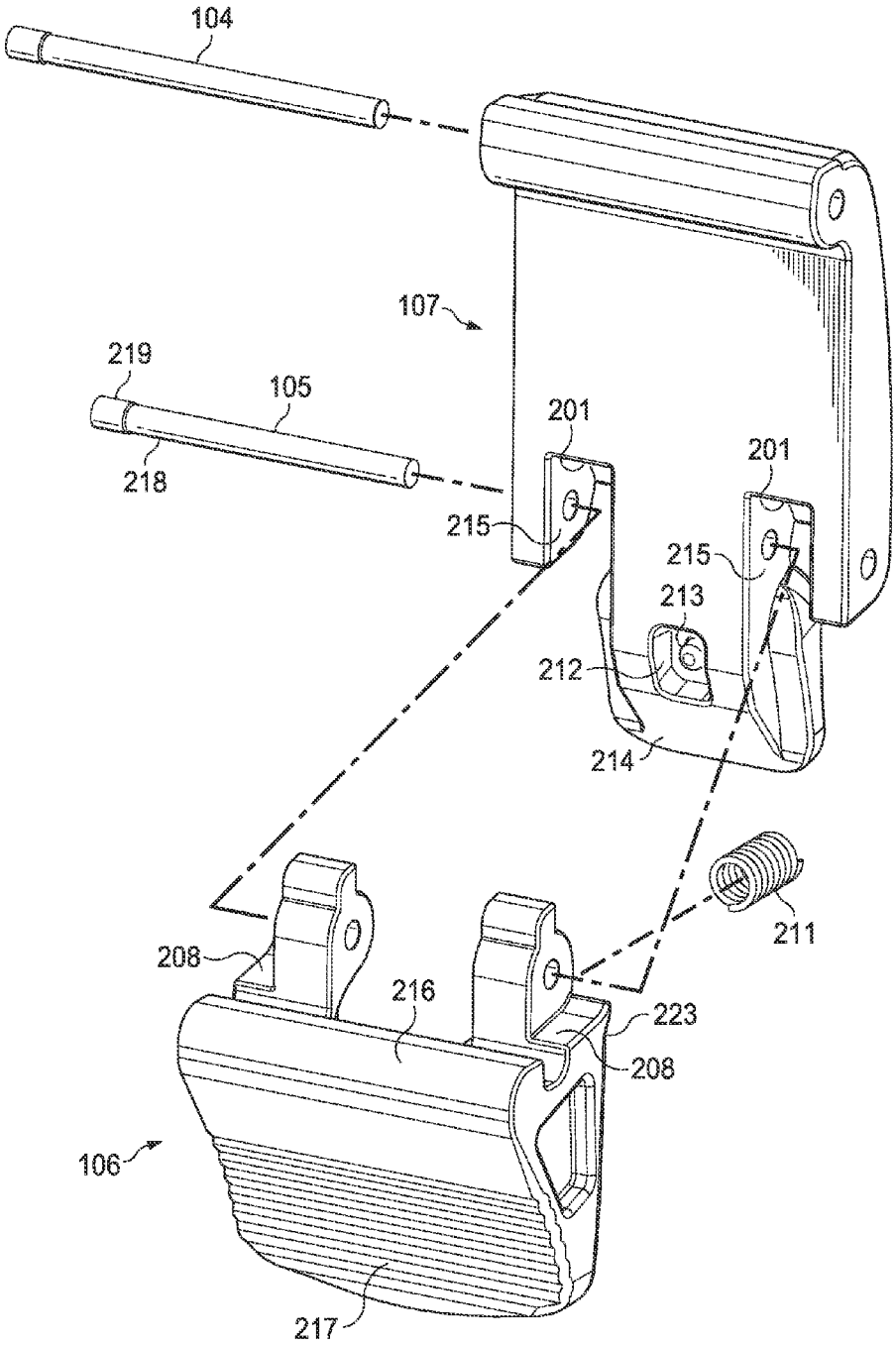

FIG. 2B is an exploded view taken from the back of latch assembly 100. As shown in FIG. 2B, closing panel 107 also includes an encasement pocket 212 extending into the body of closing panel 107, an alignment rod 213 encompassed by encasement pocket 212 and extending outwardly, upward (outward) travel-limiting surface 214, and four (4) lateral shifting travel-limiting surfaces 215. Clasp lever 106 further includes latch hook 216 and a ribbed thumb grip surface 217.

As shown in FIG. 2A, the front portion of the V-shaped by body of clasp lever 106 defines a space that receives tab 200 of closing panel 107 between sidewalls 220 of clasp lever 106 (FIG. 2B). Clasp lever extensions 221 are received into closing panel receptacles 222 defined by corresponding pairs of lateral shifting travel-limiting surfaces 215 (FIG. 2B). Apertures 204 of closing panel 107 align with apertures 210 on clasp lever 106. Lateral shifting and travel limiting surfaces 209 on clasp lever 106 are disposed adjacent corresponding lateral shifting travel-limiting surfaces 215 on closing panel 107.

Lower fixed pin 105 extends through aligned apertures 204 and 210. The narrower section 218 of lower fixed pin 105 allows clasp lever 106 to pivot with respect to closing panel 107 to the extent allowed by rotational travel-limiting surfaces 201 (closing panel 107), 207 (clasp lever 106), 208 (clasp lever 106), and 214 (closing panel 107). The larger diameter end section 219 of lower fixed pin 105 is held tightly within the corresponding aperture of closing panel 107, thereby holding clasp lever 106 and closing panel 107 together.

When latch assembly 100 is fully assembled, one open end of incessant force component 211 extends (slides) over alignment rod 206 within encasement pocket 205 of clasp lever 106. The other open end of incessant force component 211 extends (slides) over alignment rod 213 within encasement pocket 212 of closing panel 107. Generally, the longitudinal axis through the open center of incessant force component 211 aligns with the longitudinal axis of alignment rods 206 and 214 in the completed assembly. Thus, while incessant force component 211 is encased within the assemblage of closing panel 107 and clasp lever 106, and held in place by alignment rods 206 and 213, it is not otherwise attached to either closing panel 107 or clasp lever 106.

In the neutral position, when no force is applied between tab 200 on closing panel 107 and thumb grip surface 217 on clasp lever 106, incessant force component 211 maintains downward (inward) rotational travel-limiting surfaces 201 of closing panel 107 in contact with downward (inward) rotational travel-limiting surface 208 of clasp lever 106. The ribbed upper surface of tab 200 of closing panel 200 is generally parallel or slightly above the surrounding surface of the clasp lever 106.

When pressure is applied to thumb grip surface 217 of clasp latch 106, and the thumb grip of tab 200 of closing panel 107, as necessary, incessant force component 211 compresses. The force allows clasp lever 106 to pivot around lower fixed pin 105 such that sidewalls 220 travel, at least in part, past the sidewalls and upper surface of tab 200 on closing panel 107. Hook 216 rotates outward with the remainder of clasp lever 106. Outward motion of clasp lever 106 stops when travel-limiting surface 214 on closing panel 107 contacts travel-limiting surface 207 of clasp lever 106.

Figure 3A:
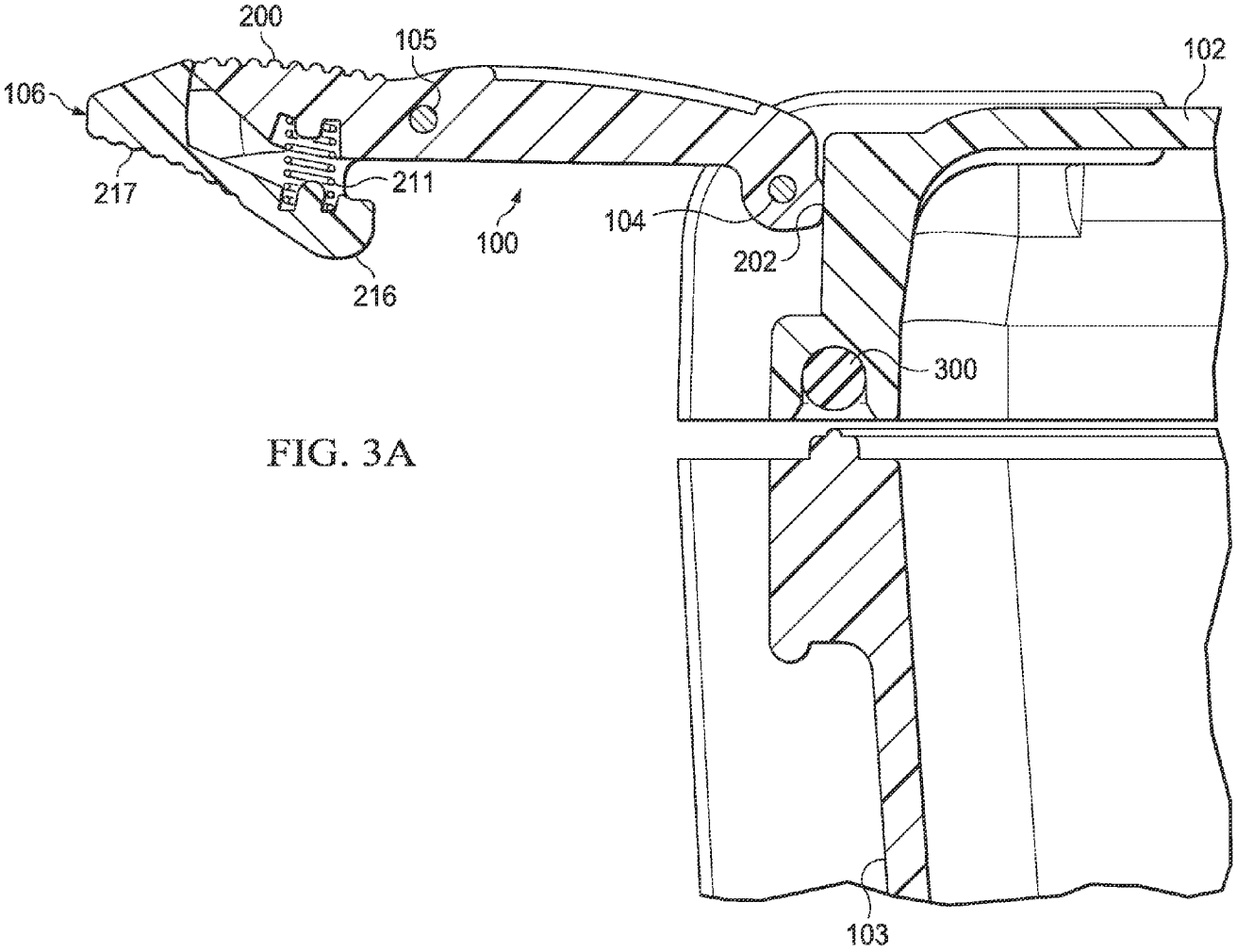
FIG. 3A is a diagram providing a cross-sectional view taken along line 3A-3A of FIG. 1B showing the latch assembly in the disengaged configuration.

FIG. 3A is a cross-sectional view taken along line 3B-3B of FIG. 1A showing of a portion of transportation container 101 with latch assembly 100 in the disengaged configuration. In the disengaged configuration, latch assembly 100 has pivoted upward around upper fixed pin 104 until travel was halted by pivot lock rib 202. Incessant force component 211 has biased closing panel 107 and clasp lever 106 to their neutral position. Container lid 102 now freely moves with respect to container base 103 and pressure on gasket 300 is released.

Figure 3B:
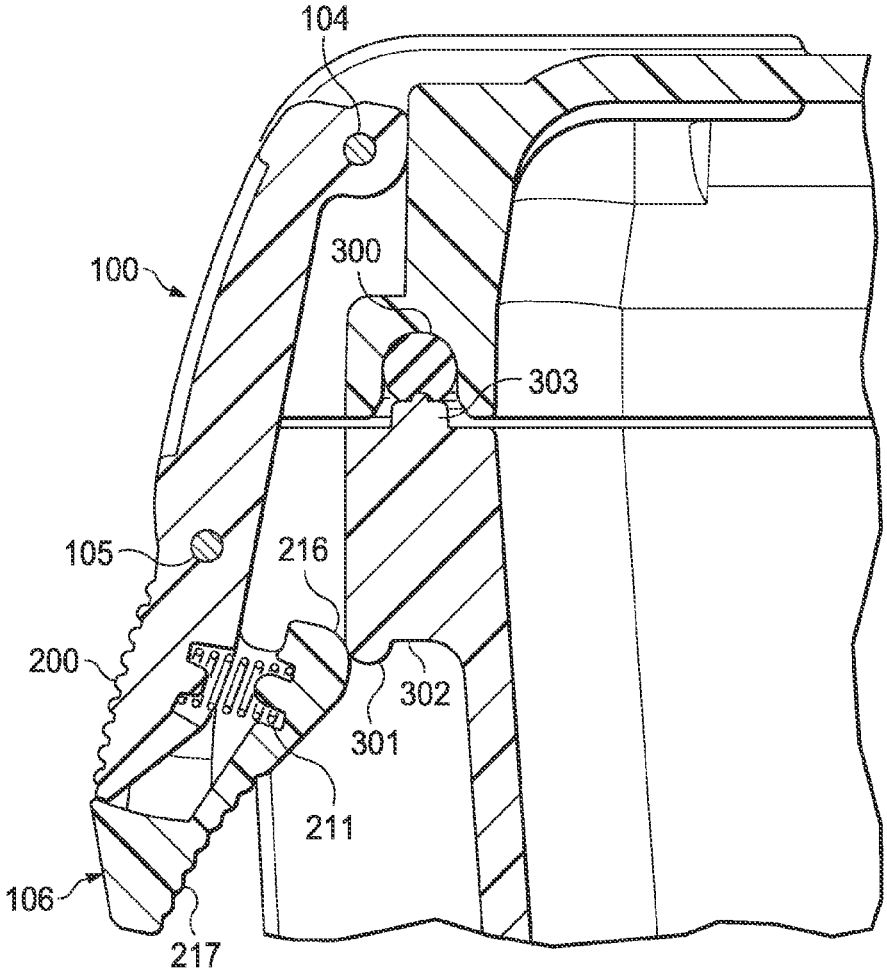
FIG. 3B is a diagram providing a cross-sectional view taken along line 3B-3B of FIG. 1A showing the latch assembly just before or just after the engaged configuration.

FIG. 3B is a cross-sectional view transportation container 101 taken along line 3A-3A of FIG. 1B showing latch assembly 100 just prior to engagement or just after disengagement. As shown in FIG. 3B, latch hook 216 is in contact with the outer surface of container latch hook 301 and outside of container latch hook depression 302. Container element barrier 303 is in contact with gasket 300, although gasket 300 is not being fully compressed.

To engage latch assembly 100 with container 101, inward pressure is applied to thumb grip surface on tab 200 on closing panel 107. Outward pressure is applied to thumb grip surface 217 on clasp lever 106, against the bias presented by incessant force component 211. Latch hook 216 rotates outward and downward around lower fixed pin 105, such that hook 216 is able to clear container latch hook 301 as inward force on thumb grip surface 200 causes latch assembly 100 as a whole to pivot further downward and inward around upper fixed pin 104. When the pressure on thumb grip surface 217 is released, incessant force component 211 causes hook 216 to pivot inward and upward into the neutral position and engage container latch hook 301 and container latch depression 302.

To disengage latch assembly 100 from container 101, outward pressure is applied to thumb grip surface 217 on clasp lever 106. Latch hook 216 rotates outward and downward against the bias presented by incessant force component 211, which allows latch hook 216 to clear container latch hook 301 as continued outward pressure applied to thumb grip surface 217 causes latch assembly 100 as a whole to rotate upward and outward around upper fixed pin 104.

Although the invention has been described with reference to specific embodiments, these descriptions are not meant to be construed in a limiting sense. Various modifications of the disclosed embodiments, as well as alternative embodiments of the invention, will become apparent to persons skilled in the art upon reference to the description of the invention. It should be appreciated by those skilled in the art that the conception and the specific embodiment disclosed might be readily utilized as a basis for modifying or designing other structures for carrying out the same purposes of the present invention. It should also be realized by those skilled in the art that such equivalent constructions do not depart from the spirit and scope of the invention as set forth in the appended claims.

It is therefore contemplated that the claims will cover any such modifications or embodiments that fall within the true scope of the invention.

What is claimed is:

1. A latch assembly comprising:

a closing panel having a body with a longitudinal axis, a lateral axis, an end with a closing panel tab extending therefrom, and a receptacle having sidewalls formed into the end of the body of the closing panel generally parallel to the longitudinal axis and laterally spaced from each other along the lateral axis, the receptacle laterally adjacent the closing panel tab along the lateral axis;

a clasp lever pivotally attached to the end of closing panel by an extension integral with a body of the clasp lever and inserted within the sidewalls of the receptacle of the closing panel, the body of the clasp lever including inner peripheral sidewalls enclosing a space into which the closing panel tab extends, wherein the inner peripheral sidewalls allow the clasp lever to rotate around outer peripheral sidewalls of the closing panel tab when the clasp lever pivots around the end of the closing panel;

a helical spring disposed within the body of the clasp lever spaced between the closing panel tab and a rear inner sidewall of the body of the clasp lever and biasing the clasp lever to a neutral position with respect to the closing panel, wherein a force applied to an outer surface of the clasp lever against the bias of the helical spring causes the clasp lever to pivot around the end of the closing panel from the neutral position;

a first alignment rod extending from an encasement pocket formed into an inner sidewall of the closing panel tab and inserted into a first end of an aperture of the helical spring;

a second alignment rod extending from an encasement pocket formed into the rear inner sidewall of the body of the clasp lever and inserted into a second end of an aperture of the helical spring; and a pin extending through at least a portion of the body of the closing panel, at least one sidewall of the receptacle, and the clasp lever extension disposed within the receptacle for allowing the clasp lever to rotate around the end of the closing panel.

2. The latch assembly of claim 1, wherein the space is open through a front sidewall of the body of the clasp lever thereby allowing access to an outer surface of the closing panel tab.

3. The latch assembly of claim 1, wherein the outer surface of the clasp lever includes ribbing.

4. The latch assembly of claim 2, wherein the outer surface of the closing panel tab includes ribbing.

5. The latch assembly of claim 1, wherein the closing panel is formed as a single body of molded plastic.

6. The latch assembly of claim 1, wherein the clasp lever body is formed a single body of molded plastic.

7. The latch assembly of claim 1, wherein the body of the clasp lever comprises a front portion and a rear portion spaced at an angle by opposing side portions to define a substantially V-shaped profile of the clasp lever.

8. The latch assembly of claim 7, wherein a space is defined through the front portion of the body of the clasp lever to allow access to a surface of the closing panel tab.

9. The latch assembly of claim 8, wherein the space defined through the front portion of the body of the clasp lever is substantially rectangular to all access to a substantially rectangular surface of the closing panel tab.

10. The latch assembly of claim 7, wherein the extension of the clasp lever is integral with the front portion of the body of the clasp lever.

11. A transportation container comprising:

a lid;

a base;

a latch assembly for selectively latching the lid to the base, comprising:

a closing panel having a longitudinal axis, a lateral axis, a first end pivotally attached to the lid and a second opposing end including an outwardly extending tab and a pair of inwardly extending receptacles, each receptacle having sidewalls formed in an end of a body of the closing panel generally parallel to the longitudinal axis and laterally spaced from each other along the lateral axis, the pair of inwardly extending receptacles laterally spaced along the lateral axis by a base of the outwardly extending tab, a first alignment rod extending from a pocket formed into a rear sidewall of the outwardly extending tab;

a clasp lever comprising:

a pair of spaced apart extensions each received within a corresponding receptacle at the second end of the closing panel for allowing the clasp lever to pivot around the second end of closing panel;

a plurality of inner sidewalls enclosing a space into which the outwardly extending tab of the closing panel extends for allowing the clasp lever to rotate around outer peripheral sidewalls of the outwardly extending tab of the closing panel when the clasp lever pivots around the second end of the closing panel;

a second alignment rod extending from a pocket formed into a rear inner sidewall of the clasp lever; and an outwardly extending hook for engaging a hook on the container base;

a helical spring disposed within the space and between the rear sidewall of the outwardly extending tab of the closing panel and the rear inner sidewall of the clasp lever for biasing the clasp lever in a neutral position with respect to the closing panel, a first end of a longitudinal space of the helical spring receiving the first alignment rod and a second end of the longitudinal space of the helical spring receiving the second alignment rod; and a pin extending through a portion of the second end of the closing panel, the sidewalls of each of the pair of inwardly extending receptacles, and the pair of clasp lever extensions within the corresponding receptacles for pivoting the clasp lever from the neutral position in response to a force applied to an outer surface of clasp lever against the bias provided by the helical spring.

12. The transportation container of claim 11, wherein the clasp lever includes a front portion having an aperture therethrough allowing access to an outer surface of the outwardly extending tab of the closing panel.

13. The transportation container of claim 12, wherein the outer surface of the outwardly extending tab includes ribs.

14. The transportation container of claim 11, wherein the outer surface of the clasp lever includes ribs.

15. The transportation container of claim 11, wherein the outwardly extending tab comprises an integral body of molded plastic.

16. The transportation container of claim 11, wherein the clasp lever is formed as an integral body of molded plastic.

17. The transportation container of claim 11, wherein the closing panel is pivotally attached to the lid with a pin.

18. The transportation container of claim 11, wherein at least one of the lid and base of the transportation container is formed of molded plastic.

19. The transportation container of claim 11, wherein the clasp lever comprises a front portion and a rear portion spaced at an angle by opposing side portions to define a substantially V-shaped profile of the clasp lever.

20. The transportation container of claim 19, wherein a space is defined through the front portion of the clasp lever to allow access to a surface of the outwardly extending tab of the closing panel.

21. The latch assembly of claim 20, wherein the space defined through the front portion of the clasp lever is substantially rectangular to allow access to a substantially rectangular surface of the outwardly extending tab of the closing panel.

22. The latch assembly of claim 19, wherein the pair of clasp lever extensions are integral with the front portion of the clasp lever.

* * * * *